US010808696B2

(12) United States Patent
Tsuzuki

(10) Patent No.: US 10,808,696 B2
(45) Date of Patent: Oct. 20, 2020

(54) GEAR PUMP OR GEAR MOTOR WITH SHAFT CONNECTING MEMBER

(71) Applicant: DAIKIN INDUSTRIES, LTD., Osaka-shi, Osaka (JP)

(72) Inventor: Katsunari Tsuzuki, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/338,297

(22) PCT Filed: Sep. 26, 2017

(86) PCT No.: PCT/JP2017/034780

§ 371 (c)(1),
(2) Date: Mar. 29, 2019

(87) PCT Pub. No.: WO2018/062198

PCT Pub. Date: Apr. 5, 2018

(65) Prior Publication Data

US 2019/0338769 A1 Nov. 7, 2019

(30) Foreign Application Priority Data

Sep. 30, 2016 (JP) ..... 2016-192812

(51) Int. Cl.
*F04C 2/16* (2006.01)
*F03C 2/08* (2006.01)
(Continued)

(52) U.S. Cl.
CPC ..... *F04C 2/16* (2013.01); *F03C 2/08* (2013.01); *F04C 2/084* (2013.01); *F04C 11/00* (2013.01); *F04C 11/001* (2013.01); *F04C 15/00* (2013.01)

(58) Field of Classification Search
CPC ..... F03C 2/08; F04C 11/00; F04C 11/001; F04C 15/00; F04C 2/084; F04C 2/16; F04C 2/18
See application file for complete search history.

(56) References Cited

U.S. PATENT DOCUMENTS 6,887,055 B2 5/2005 Morselli
2009/0311120 A1 12/2009 Okada
(Continued)

FOREIGN PATENT DOCUMENTS

CN 101379295 A 3/2009
JP S63-186985 U 11/1988
(Continued)

OTHER PUBLICATIONS

International Preliminary Report of corresponding PCT Application No. PCT/JP2017/034780 dated Apr. 2, 2019.
(Continued)

*Primary Examiner* — Mary Davis
(74) *Attorney, Agent, or Firm* — Global IP Counselors, LLP

(57) ABSTRACT

A gear pump or motor includes a main pump or motor connected to a drive source, and an auxiliary pump or motor. The main pump or motor includes helical main drive and driven gears, and a main drive shaft. A main connection part is formed at a leading end surface of the main drive shaft. The auxiliary pump or motor includes an auxiliary drive shaft extending toward the main drive shaft, an auxiliary connection part formed at a leading end face of the auxiliary drive shaft. A connecting member connects the main and auxiliary connection parts, and is in contact with an outer edge portion of the leading end face of the main drive shaft. A space opposes a receiving surface of the connecting member. The receiving surface opposes the auxiliary pump or motor. High-pressure operating fluid is supplied to the space.

15 Claims, 10 Drawing Sheets

(51) Int. Cl.

| | |
|---|---|
| ***F04C 11/00*** | (2006.01) |
| ***F04C 2/08*** | (2006.01) |
| ***F04C 15/00*** | (2006.01) |

(56) References Cited

U.S. PATENT DOCUMENTS

| | | | | |
|---|---|---|---|---|
| 2016/0265528 | A1 * | 9/2016 | Ferretti | F04C 2/084 |
| 2017/0298934 | A1 | 10/2017 | Tsuzuki | |

FOREIGN PATENT DOCUMENTS

| | | | | |
|---|---|---|---|---|
| JP | H2-76186 | U | 6/1990 | |
| JP | H09-264270 | A | 10/1997 | |
| JP | 2016-070210 | A | 5/2016 | |
| WO | WO-2014191253 | A1 * | 12/2014 | F04C 15/0042 |

OTHER PUBLICATIONS

International Search Report dated Nov. 28, 2017 in corresponding International Application No. PCT/JP2017/034780, filed Sep. 26, 2017 (with English Translation).

European Search Report of corresponding EP Application No. 17 85 6148.6 dated Feb. 10, 2020.

* cited by examiner

GEAR PUMP OR GEAR MOTOR WITH SHAFT CONNECTING MEMBER

BACKGROUND

Field of the Invention

The present teaching relates to a gear pump or a gear motor which includes: a main pump or a main motor which is connected to a drive source; and an auxiliary pump or an auxiliary motor which is connected in series to the main pump or the main motor, the main pump or the main motor being positioned between the drive source and the auxiliary pump or the auxiliary motor.

Background Information

When each of a drive gear and a driven gear of the gear pump or the gear motor is a helical gear, each end face perpendicular to the axial direction of each of the drive gear and the driven gear is pressed by a side plate on account of thrust force due to meshing of the teeth or thrust force generated by hydraulic pressure acting on a tooth surface. Each end face of each of the drive gear and the driven gear is therefore worn, and the mechanical efficiency of the gear pump or the gear motor is deteriorated due to the wear.

In this regard, U.S. Pat. No. 6,887,055 proposes a gear pump which is arranged such that a piston is provided to be in contact with a central portion of a leading end face of each of a drive shaft of a drive gear and a driven shaft of a driven gear and the piston presses the drive shaft and the driven shaft to cancel out the thrust force.

SUMMARY

However, when the gear pump recited in U.S. Pat. No. 6,887,055 is connected in series with another pump and the drive shaft of the gear pump of U.S. Pat. No. 6,887,055 is connected to the drive shaft of the other pump, there is no space to provide a piston to be in contact with a central portion of the leading end face of each drive shaft and hence thrust force generated in the drive gear cannot be canceled out.

An object of the present teaching is to provide a gear pump or a gear motor which is able to cancel out thrust force generated in a drive gear even when there is no space to provide a piston in contact with a central portion of the leading end face of a drive shaft.

A gear motor or a gear pump of the present teaching comprises: a main pump or a main motor which is connected to a drive source; and an auxiliary pump or an auxiliary motor which is connected in series to the main pump or the main motor, the main pump or the main motor being positioned between the drive source and the auxiliary pump or the auxiliary motor, the main pump or the main motor including: a main drive gear and a main driven gear each of which is a helical gear; and a main drive shaft which extends toward the auxiliary pump or the auxiliary motor from an end face of the main drive gear, the end face opposing the auxiliary pump or the auxiliary motor, and a main connection part being formed at a leading end surface of the main drive shaft, the auxiliary pump or the auxiliary motor including an auxiliary drive shaft which extends toward the main drive shaft, an auxiliary connection part being formed at a leading end face of the auxiliary drive shaft. The gear pump or the gear motor further comprises: a connecting member which connects the main connection part with the auxiliary connection part and is in contact with an outer edge portion of the leading end face of the main drive shaft; and a space which opposes a receiving surface of the connecting member, the receiving surface opposing the auxiliary pump or the auxiliary motor, and operating fluid being supplied to the space.

According to the present teaching, when high-pressure operating fluid is supplied to the space, the connecting member which is in contact with the outer edge portion of the leading end face of the main drive shaft presses the main drive shaft toward the drive source. This makes it possible to cancel out the thrust force generated in the main drive gear, even when there is no space to provide a piston to be in contact with the central portion of the leading end face of the main drive shaft.

The gear pump or the gear motor of the present teaching may further include a pressing member which is in contact with the receiving surface and opposes the space.

According to this arrangement, with the pressing member, the degree of freedom in position, inclination, etc. of the connecting member is improved in the space in which the connecting member is provided. This restrains the main connection part, the auxiliary connection part, and the connecting member from being worn due to misalignment between the main drive shaft and the auxiliary drive shaft, so as to restrain mechanical loss on account of the wear. When the pressing member is not provided, because the connecting member is tilted due to force generated by the misalignment between the main drive shaft and the auxiliary drive shaft, a member provided around the connecting member and the connecting member make contact with each other and are worn, with the result that leakage of the operating fluid may increase. This problem is prevented by the pressing member of the arrangement above.

The gear motor or the gear pump of the present teaching may be arranged such that, the connecting member has an inner surface which extends in an axial direction of the main drive gear and opposes the main connection part and the auxiliary connection part and an outer surface which extends in the axial direction and does not oppose the main connection part and the auxiliary connection part, and the pressing member opposes the outer surface.

According to this arrangement, the length in the axial direction of the element including the connecting member and the pressing member is shortened as compared to a case where the pressing member opposes an end face perpendicular to the axial direction of the connecting member, with the result that the gear pump or the gear motor is downsized.

The gear motor or the gear pump of the present teaching may be arranged such that, the connecting member includes a protrusion which protrudes from the outer surface, and the receiving surface is a surface of the protrusion, which opposes the auxiliary pump or the auxiliary motor.

According to this arrangement, when the high-pressure operating fluid is supplied to the space, the pressing member certainly presses the connecting member toward the drive source through the intermediary of the receiving surface of the protrusion.

The gear pump or the gear motor of the present teaching may further comprise a main casing which houses the main drive gear and the main driven gear, the main casing including: a main body which has a main through hole in which the main drive gear and the main driven gear are provided and openings which are formed in one end face close to the drive source and another end face far from the drive source so as to communicate with the main through hole; a mounting which closes the opening formed in the one end face; and a main flange which closes the opening formed in the another end face and has a main insertion hole in which the main connection part and the connecting member are provided. The pressing member may be provided in the main insertion hole, and an introduction passage may be formed in the main flange to introduce the operating fluid from the main through hole to the space, one end of the introduction passage communicating with a high-pressure area of the main through hole whereas another end of the introduction passage communicating with the space.

This arrangement makes it possible to shorten the introduction passage. This facilitates the machining of the gear pump or the gear motor.

The gear motor or the gear pump of the present teaching may further comprise: a main casing which houses the main drive gear and the main driven gear, the main casing including: a main body which has a main through hole in which the main drive gear, the main driven gear, and a bearing which rotatably supports the main drive shaft are provided and openings which are formed in one end face close to the drive source and another end face far from the drive source so as to communicate with the main through hole; a mounting which closes the opening formed in the one end face; and a main flange which closes the opening formed in the another end face and has a main insertion hole in which the main connection part and the connecting member are provided; and an auxiliary casing which houses an auxiliary drive gear and an auxiliary driven gear of the auxiliary pump or the auxiliary motor, the auxiliary casing including: an auxiliary body which has an auxiliary through hole in which the auxiliary drive gear and the auxiliary driven gear are provided and openings which are formed in one end face close to the drive source and another end face far from the drive force so as to communicate with the auxiliary through hole; an auxiliary flange which closes the opening formed in the one end face and has an auxiliary insertion hole in which the auxiliary connection part and the connecting member are provided; and a cover which closes the opening formed in the another end face. The pressing member may be provided in the auxiliary insertion hole, and an introduction passage may be formed in the main flange and the auxiliary flange to introduce the operating fluid from the main through hole to the space, one end of the introduction passage communicating with a high-pressure area of the main through hole whereas another end of the introduction passage communicating with the space.

With this arrangement, the contact area between the bearing and the main flange is large. This restrains the operating fluid from leaking through a gap between the bearing and the main flange, and hence the volume efficiency of the pump is improved.

The gear pump or the gear motor of the present teaching may further comprise three or more pumps or three or more motors connected in series to the drive source, the three or more pumps or the three or more motors including: the main pump or the main motor; and the auxiliary pump or the auxiliary motor.

According to this arrangement, the degree of freedom in design in consideration of the use is improved.

According to the present teaching, when high-pressure operating fluid is supplied to the space, the connecting member which is in contact with the outer edge portion of the leading end face of the main drive shaft presses the main drive shaft toward the drive source. This makes it possible to cancel out the thrust force generated in the main drive gear, even when there is no space to provide a piston to be in contact with the central portion of the leading end face of the main drive shaft.

Furthermore, with the pressing member in contact with the receiving surface and opposing the space, the degree of freedom in position, inclination, etc. of the connecting member is improved in the space in which the connecting member is provided. This restrains the main connection part, the auxiliary connection part, and the connecting member from being worn due to misalignment between the main drive shaft and the auxiliary drive shaft, so as to restrain mechanical loss on account of the wear. When the pressing member is not provided, because the connecting member is tilted due to force generated by the misalignment between the main drive shaft and the auxiliary drive shaft, a member provided around the connecting member and the connecting member make contact with each other and are worn, with the result that leakage of the operating fluid may increase. This problem is prevented by the pressing member of the arrangement above.

Furthermore, when the pressing member opposes the outer surface of the connecting member, which does not oppose the main connection part and the auxiliary connection part, the length in the axial direction of the element including the connecting member and the pressing member is shortened as compared to a case where the pressing member opposes an end face perpendicular to the axial direction of the connecting member, with the result that the gear pump or the gear motor is downsized.

Furthermore, in cases where the receiving surface is a surface of the protrusion formed in the connecting member, which faces the auxiliary pump or the auxiliary motor, and when the high-pressure operating fluid is supplied to the space, the pressing member certainly presses the connecting member toward the drive source through the intermediary of the receiving surface of the protrusion.

Furthermore, the introduction passage is shortened when the pressing member is provided in the main insertion hole and the introduction passage is formed in the main flange. This facilitates the machining of the gear pump or the gear motor.

Furthermore, when the pressing member is provided in the auxiliary insertion hole and the introduction passage is formed in the main flange and the auxiliary flange, the contact area between the bearing provided in the main through hole and the main flange is large. This restrains the operating fluid from leaking through a gap between the bearing and the main flange, and hence the volume efficiency of the pump is improved.

Furthermore, the degree of freedom in design in consideration of the use is improved, when three or more pumps or motors which are connected in series to the drive source and include the main pump or the main motor and the auxiliary pump or the auxiliary motor are provided.

DESCRIPTION OF EMBODIMENTS

The following describes an embodiment of the present teaching with reference to attached drawings.

Figure 1:
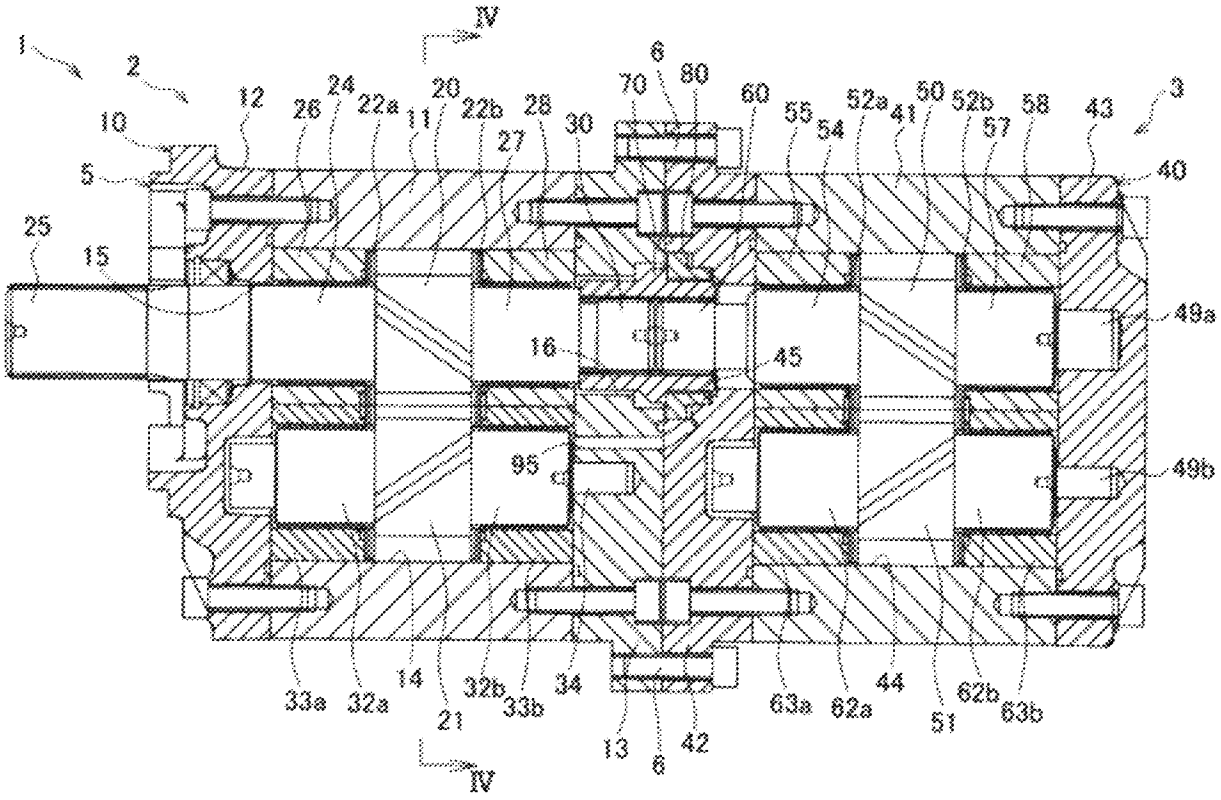
FIG. 1 is a cross section of a gear pump of an embodiment of the present teaching.

As shown in FIG. 1, a gear pump 1 of the present embodiment includes a main pump 2 directly connected to a drive source (not illustrated) and an auxiliary pump 3 connected in series to the main pump 2. The auxiliary pump 3 is provided on the side opposite to the drive source over the main pump 2 (i.e., the main pump 2 is positioned between the drive source and the auxiliary pump 3). The gear pump 1 sucks operating fluid (e.g., operating oil) supplied from a tank storing the operating fluid and increases the pressure, and then discharges and supplies the operating fluid to fluid pressure equipment.

A casing 5 of the gear pump 1 includes a main casing 10 which houses a main drive gear 20 and a main driven gear 21 of the main pump 2 and an auxiliary casing 40 which is fixed to the main casing 10 by a bolt 6 and houses an auxiliary drive gear 50 and an auxiliary driven gear 51 of the auxiliary pump 3. The auxiliary drive gear 50 and the auxiliary driven gear 51 are provided on the side opposite to the drive source over the main drive gear 20 and the main driven gear 21 (i.e., the gears 20 and 21 are positioned between the drive source and the gears 50 and 51).

The main pump 2 includes the main casing 10, the main drive gear 20 and the main driven gear 21 meshing with each other, main drive shafts 24 and 27 pivotally supporting the main drive gear 20, and main driven shafts 32*a* and 32*b* pivotally supporting the main driven gear 21.

The main casing 10 includes a main body 11, a mounting 12, and a main flange 13. The main body 11 covers the outer circumferences of the main drive gear 20 and the main driven gear 21. The mounting 12 and the main flange 13 are screwed and fixed to two end faces of the main body 11, respectively. The end faces are perpendicular to the axial direction of the main drive gear 20 (left-right direction in FIG. 1; this direction will be simply referred to as axial direction).

Figure 4:
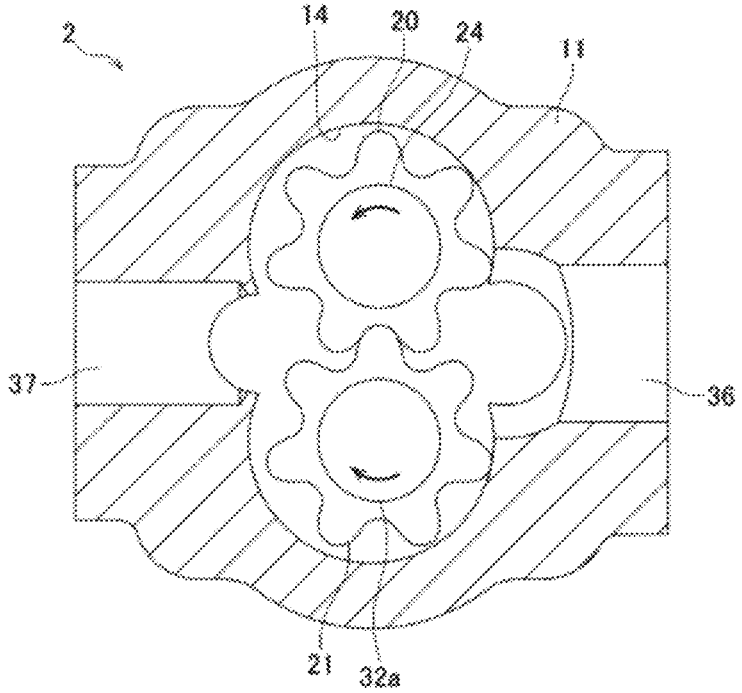
FIG. 4 is a cross section taken along a IV-IV line in FIG. 1.

As shown in FIG. 4, the main body 11 has an internal space (main through hole 14) which is substantially 8-shaped (spectacle-shaped) in cross section. The main drive gear 20 and the main driven gear 21 are provided in the main through hole 14. As shown in FIG. 1, the main through hole 14 penetrates the main body 11 in the axial direction. For this reason, in each of the two end faces perpendicular to the axial direction of the main body 11, an opening is formed to communicate with the main through hole 14. The mounting 12 closes the opening formed in one of the two end faces of the main body 11, which is close to the drive source as compared to the other end face. The main flange 13 closes the opening formed in the other one of the two end faces of the main body 11, which is far from the drive source as compared to the one end face. One end face of the main body 11 opposes the drive source. The other end face of the main body 11 opposes the auxiliary pump 3.

In the mounting 12, an insertion hole 15 is formed to penetrate the mounting 12 in the axial direction. The insertion hole 15 opposes the main drive shaft 24 in the axial direction.

A main insertion hole 16 and a part of an introduction passage 95 are formed in the main flange 13. The main insertion hole 16 and the part of the introduction passage 95 penetrate the main flange 13 in the axial direction. The main insertion hole 16 opposes the main drive shaft 27 in the axial direction. The part of the introduction passage 95 opposes the main driven shaft 32*b* in the axial direction. One end of the part of the introduction passage 95, which is close to the main driven gear 21 as compared to the other end, communicates with a high-pressure space in the main through hole 14.

Figure 2:
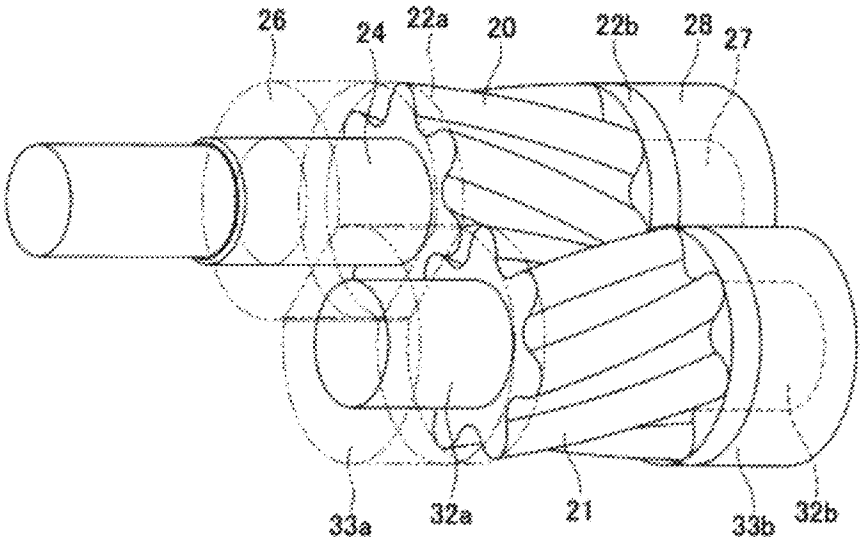
FIG. 2 is a perspective view of a main drive gear and a main driven gear which are included in the gear pump shown in FIG. 1.

As shown in FIG. 2, each of the main drive gear 20 and the main driven gear 21 is a helical gear. The main drive gear 20 and the main driven gear 21 rotate together in the main through hole 14 in a state in which these gears mesh with each other. At this stage, tooth tips of the main drive gear 20 and the main driven gear 21 are slidably in contact with the inner circumferential surface of the main body 11. This inner circumferential surface defines the main through hole 14.

On the respective end faces perpendicular to the axial direction of the main drive gear 20 and the main driven gear 21, main side plates 22*a* and 22*b* are provided to oppose the respective end faces. The main side plate 22*a* has two through holes into which the main drive shaft 24 and the main driven shaft 32*a* are inserted, respectively. The main side plate 22*a* is in contact with one of the two end faces perpendicular to the axial direction of each of the main drive gear 20 and the main driven gear 21, which end face is close to the drive source as compared to the other end face. The main side plate 22*b* has two through holes into which the main drive shaft 27 and the main driven shaft 32*b* are inserted, respectively. The main side plate 22*b* is in contact with the other one of the two end faces perpendicular to the axial direction of each of the main drive gear 20 and the main driven gear 21, which end face is far from the drive source as compared to the one end face. One end face of each of the main drive gear 20 and the main driven gear 21 opposes the driving source. The other end face of each of the main drive gear 20 and the main driven gear 21 opposes the auxiliary pump 3.

The main drive shaft 24 extends from one end face of the main drive gear 20 toward the drive source along the axial direction. The main drive shaft 24 is inserted into the insertion hole 15 of the mounting 12. The drive source (not illustrated) is connected to a leading end portion 25 of the main drive shaft 24. The main drive shaft 24 is rotatably supported by a bearing 26 provided in the main through hole 14. The bearing 26 is constituted by bearing balls and a bearing case. Each of bearings described below is also constituted by bearing balls and a bearing case.

Figure 3:
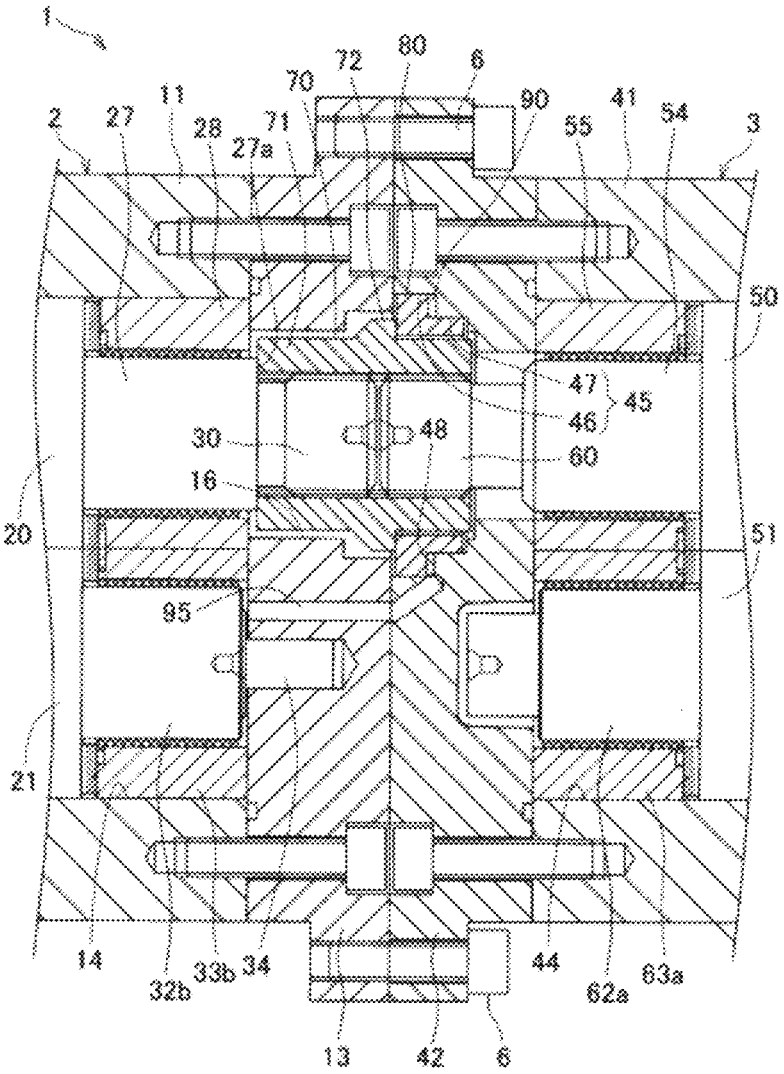
FIG. 3 is a partially enlarged cross sectional view showing a connecting portion where a main pump and an auxiliary pump included in the gear pump of FIG. 1 are connected to each other.

The main drive shaft 27 extends from the other end face of the main drive gear 20 toward the auxiliary pump 3 along the axial direction. As shown in FIG. 3, a main connection part 30 is formed at a leading end face 27*a* of the main drive shaft 27. The main drive shaft 27 is rotatably supported by a bearing 28 provided in the main through hole 14.

The main connection part 30 is cylindrical in shape, is shorter in diameter than the main drive shaft 27, and is integrally formed with the main drive shaft 27. The main connection part 30 extends from the leading end face 27*a* of the main drive shaft 27 toward the auxiliary drive gear 50 along the axial direction. The main connection part 30 is provided in the main insertion hole 16.

As shown in FIG. 1, the main driven shaft 32*a* extends from one end face of the main driven gear 21 toward the drive source along the axial direction. The main driven shaft 32*a* is rotatably supported by a bearing 33*a* provided in the main through hole 14. The main driven shaft 32*b* extends from the other end face of the main driven gear 21 toward the auxiliary pump 3 along the axial direction. The main driven shaft 32*b* is rotatably supported by a bearing 33*b* provided in the main through hole 14. A piston 34 is provided to be in contact with the leading end face of the main driven shaft 32*b*. The piston 34 has a function of canceling out thrust force generated in the main driven gear 21 by pressing the main driven shaft 32*b* along the axial direction toward the drive source.

The auxiliary pump 3 includes the auxiliary casing 40, the auxiliary drive gear 50 and the auxiliary driven gear 51 meshing with each other, auxiliary drive shafts 54 and 57 pivotally supporting the auxiliary drive gear 50, and auxiliary driven shafts 62*a* and 62*b* pivotally supporting the auxiliary driven gear 51.

The auxiliary casing 40 includes an auxiliary body 41, an auxiliary flange 42, and a cover 43. The auxiliary body 41 covers the outer circumferences of the auxiliary drive gear 50 and the auxiliary driven gear 51. The auxiliary flange 42 and the cover 43 are screwed and fixed to two end faces perpendicular to the axial direction of the auxiliary body 41.

The auxiliary body 41 includes an internal space (auxiliary through hole 44) which is substantially 8-shaped (spectacle-shaped) in cross section, in a manner similar to the main through hole 14 shown in FIG. 4. The auxiliary drive gear 50 and the auxiliary driven gear 51 are provided in the auxiliary through hole 44. As shown in FIG. 1, the auxiliary through hole 44 penetrates the auxiliary body 41 in the axial direction. For this reason, in each of the two end faces perpendicular to the axial direction of the auxiliary body 41, an opening is formed to communicate with the auxiliary through hole 44. The auxiliary flange 42 closes the opening formed in one of the two end faces of the auxiliary body 41, which is close to the drive source as compared to the other end face. The cover 43 closes the opening formed in the other one of the two end faces of the auxiliary body 41, which is far from the drive source as compared to the one end face. The one end face of the auxiliary body 41 opposes the main pump 2.

In the auxiliary flange 42, an auxiliary insertion hole 45 is formed to penetrate the auxiliary flange 42 in the axial direction. The auxiliary insertion hole 45 opposes the auxiliary drive gear 50 in the axial direction. As shown in FIG. 3, the auxiliary insertion hole 45 is defined by an inner circumferential surface 46 and an inner circumferential surface 47 which is shorter in diameter than the inner circumferential surface 46. The inner circumferential surfaces 46 and 47 are connected to each other by a step 48. The inner circumferential surface 46 is close to the main pump 2 as compared to the inner circumferential surface 47.

As shown in FIG. 1, pistons 49*a* and 49*b* are provided in the cover 43. The piston 49*a* opposes the auxiliary drive gear 50 in the axial direction and is in contact with the auxiliary drive shaft 57. The piston 49*a* has a function of canceling out thrust force generated in the auxiliary drive gear 50 by pressing the auxiliary drive shaft 57 along the axial direction toward the main pump 2. The piston 49*b* opposes the auxiliary driven gear 51 in the axial direction and is in contact with the auxiliary driven shaft 62*b*. The piston 49*b* has a function of canceling out thrust force generated in the auxiliary driven gear 51 by pressing the auxiliary driven shaft 62*b* along the axial direction toward the main pump 2.

Being similar to the main drive gear 20 and the main driven gear 21, each of the auxiliary drive gear 50 and the auxiliary driven gear 51 is a helical gear. The auxiliary drive gear 50 and the auxiliary driven gear 51 rotate together in the auxiliary through hole 44 in a state in which these gears mesh with each other. At this stage, tooth tips of the auxiliary drive gear 50 and the auxiliary driven gear 51 are slidably in contact with the inner circumferential surface of the auxiliary body 41. This inner circumferential surface defines the auxiliary through hole 44. The auxiliary pump 3 may be any type of pump and may not include a helical gear, as long as the auxiliary pump 3 includes a drive shaft.

On the respective end faces perpendicular to the axial direction of the auxiliary drive gear 50 and the auxiliary driven gear 51, auxiliary side plates 52*a* and 52*b* are provided to oppose the respective end faces. The auxiliary side plate 52*a* has two through holes into which the auxiliary drive shaft 54 and the auxiliary driven shaft 62*a* are inserted, respectively. The auxiliary side plate 52*a* is in contact with one of the two end faces perpendicular to the axial direction of each of the auxiliary drive gear 50 and the auxiliary driven gear 51, which end face is close to the drive source as compared to the other end face. The auxiliary side plate 52*a* has two through holes into which the auxiliary drive shaft 57 and the auxiliary driven shaft 62*a* are inserted, respectively. The auxiliary side plate 52*b* is in contact with the other one of the two end faces perpendicular to the axial direction of each of the auxiliary drive gear 50 and the auxiliary driven gear 51, which end face is far from the axis as compared to the one end face. The one end faces of the auxiliary drive gear 50 and the auxiliary driven gear 51 oppose the main pump 2.

The auxiliary drive shaft 54 extends from the one end face of the auxiliary drive gear 50 toward the main drive shaft 27 along the axial direction. An auxiliary connection part 60 is formed at a leading end face of the auxiliary drive shaft 54. The auxiliary drive shaft 54 is rotatably supported by a bearing 55 provided in the auxiliary through hole 44.

The auxiliary connection part 60 is cylindrical in shape, is shorter in diameter than the auxiliary drive shaft 54, and is integrally formed with the auxiliary drive shaft 54. The auxiliary connection part 60 extends from a leading end face of the auxiliary drive shaft 54 toward the main pump 2 along the axial direction. The auxiliary connection part 60 is provided in the auxiliary insertion hole 45. The leading end of the auxiliary connection part 60 and the leading end of the main connection part 30 oppose each other in the axial direction over a slight gap. The auxiliary connection part 60 is connected to the main connection part 30 by a connecting member 70.

The auxiliary drive shaft 57 extends from the other end face of the auxiliary drive gear 50 and away from the main pump 2, along the axial direction. The auxiliary drive shaft 57 is rotatably supported by a bearing 58 provided in the auxiliary through hole 44.

The auxiliary driven shaft 62*a* extends from the one end face of the auxiliary driven gear 51 toward the main pump 2 along the axial direction. The auxiliary driven shaft 62*a* is rotatably supported by a bearing 63*a* provided in the auxiliary through hole 44. The auxiliary driven shaft 62*b* extends from the other end face of the auxiliary driven gear 51 and away from the main pump 2, along the axial direction. The auxiliary driven shaft 62*b* is rotatably supported by a bearing 63*b* provided in the auxiliary through hole 44.

As shown in FIG. 4, a sucking hole 36 and a discharging hole 37 are formed in the main body 11. The sucking hole 36 and the discharging hole 37 sandwich the main through hole 14 and extend in the direction perpendicular to the axial direction. The sucking hole 36 communicates with a low-pressure space in the main through hole 14. The discharging hole 37 communicates with a high-pressure space in the main through hole 14. The sucking hole 36 is connected to a pipe from the tank. The discharging hole 37 is connected to a pipe toward the fluid pressure equipment.

As the main drive shaft 24 of the main drive gear 20 is rotationally driven by the drive source, the main driven gear 21 meshing with the main drive gear 20 is rotated. As a result of this, operating fluid in a space surrounded by the inner circumferential surface of the main body 11 defining the main through hole 14 and the teeth surfaces of the main drive gear 20 and the main driven gear 21 is transferred to the discharging hole 37 on account of the rotation of the gears. At this stage, the space in the main through hole 14 includes a high-pressure space which is close to the discharging hole 37 as compared to the meshing portion of the main drive gear 20 and the main driven gear 21 and a low-pressure space which is close to the sucking hole 36 as compared to the meshing portion.

When the pressure in the low-pressure space becomes a negative pressure on account of the transfer of the operating fluid to the discharging hole 37, operating fluid in the tank is sucked into the low-pressure space via the pipe and the sucking hole 36. The operating fluid in the space surrounded by the inner circumferential surface of the main body 11 defining the main through hole 14 and the teeth surfaces of the main drive gear 20 and the main driven gear 21 is transferred to the discharging hole 37 on account of the rotation of the gears. In so doing, the operating fluid is highly pressurized and transferred to the fluid pressure equipment via the discharging hole 37 and the pipe.

The sucking hole 36 and the discharging hole 37 of the main pump 2 have been described. The auxiliary pump 3 will not be described in detail because the arrangement and effects of this pump are similar to those of the main pump 2. The auxiliary pump 3, however, is different from the main pump 2 in drive force transfer from the drive source. To be more specific, when the main drive shaft 24 of the main drive gear 20 is rotationally driven by the drive source, the main connection part 30 integrated with the main drive gear 20 is rotated, too. When the main connection part 30 is rotated, the auxiliary connection part 60 connected to the main connection part 30 by the connecting member 70 is rotated, too. As a result, the auxiliary drive gear 50 and the auxiliary driven gear 51 are rotated.

The following will describe the structure of the connecting portion between the main drive gear 20 and the auxiliary drive gear 50 (i.e., the structure of the connecting portion between the main connection part 30 and the auxiliary connection part 60).

Figure 5:
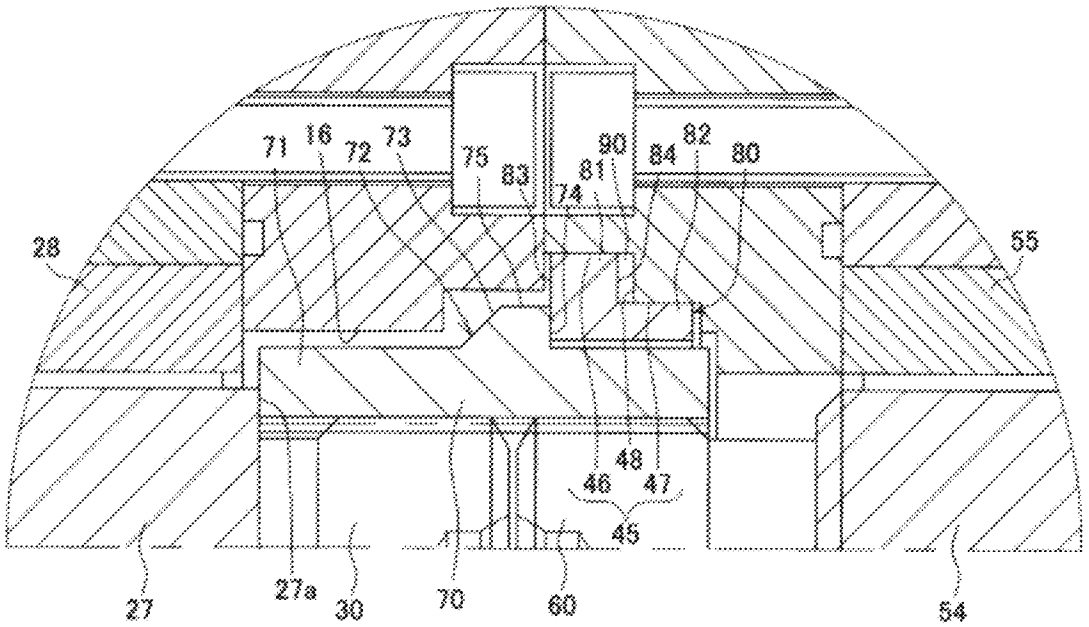
FIG. 5 is a partially enlarged cross sectional view showing the details of the connecting portion shown in FIG. 3.

As shown in FIG. 5, the main connection part 30 and the auxiliary connection part 60 are connected to each other by the connecting member 70. The connecting member 70 is pressed toward the drive source (i.e., toward the main drive gear 20) along the axial direction, by a pressing member 80 which is pressed by high-pressure operating fluid supplied to a space 90.

As shown in FIG. 3, the connecting member 70 is a substantially cylindrical coupling having a through hole extending along the axial direction. The connecting member 70 is provided in the main insertion hole 16 and the auxiliary insertion hole 45. The connecting member 70 has an inner surface and an outer surface. The inner surface extends in the axial direction and opposes the main connection part 30 and the auxiliary connection part 60. The outer surface extends in the axial direction and does not oppose the main connection part 30 and the auxiliary connection part 60. The connecting member 70 meshes with the outer circumferences of the main connection part 30 and the auxiliary connection part 60, and is able to rotate together with the main connection part 30 and the auxiliary connection part 60. An end face 71 of the connecting member 70, which opposes the main pump 2 in the axial direction, is in contact with an outer edge portion of the leading end face 27*a* of the main drive shaft 27.

At a central portion in the axial direction of the connecting member 70, a protrusion 72 is formed to protrude from the outer surface of the connecting member 70 outward in the radial direction of the connecting member 70 (this direction is the up-down direction in FIG. 3 and will be simply referred to as a radial direction). The protrusion 72 is trapezoidal in cross section taken along the axial direction. As shown in FIG. 5, the protrusion 72 includes a slope surface 73, a receiving surface 74, and a circumferential surface 75. The protrusion 72 is close to the main drive gear 20 in the axial direction. The receiving surface 74 is far from the main drive gear 20 (i.e., close to the auxiliary drive gear 50) in the axial direction. The circumferential surface 75 connects the slope surface 73 to the receiving surface 74 and forms a leading end face of the protrusion 72.

The slope surface 73 extends in a direction intersecting with both the axial direction and the radial direction from the outer surface of the connecting member 70, and opposes the main drive gear 20. The receiving surface 74 extends outward in the radial direction from the outer surface of the connecting member 70, and opposes the auxiliary drive gear 50. The circumferential surface 75 extends along the axial direction.

As shown in FIG. 3, the pressing member 80 is ring-shaped and opposes the outer surface of the connecting member 70. The pressing member 80 is close to the auxiliary drive gear 50 as compared to the protrusion 72 and is provided in the auxiliary insertion hole 45. The pressing member 80 is L-shaped in cross section taken along the axial direction. As shown in FIG. 5, the pressing member 80 includes a thick portion 81 and a thin portion 82. The thick portion 81 is one of the portions close to the main drive gear 20 in the axial direction. The thin portion 82 is the other one of the portions far from the main drive gear 20 (i.e., close to the auxiliary drive gear 50) in the axial direction and is thinner than the thick portion 81 in the radial direction.

The thick portion 81 includes a first surface 83 in contact with the receiving surface 74 and a second surface 84 opposing the space 90. Each of the first surface 83 and the second surface 84 extends in the radial direction.

The space 90 is a sealed space which is formed in the auxiliary insertion hole 45 and is defined by the pressing member 80, the inner circumferential surface 46, and the step 48. To be more specific, the space 90 is sealed as the thick portion 81 is slidably in contact with the inner circumferential surface 46 and the thin portion 82 is slidably in contact with the inner circumferential surface 47. The space 90 is a gap between the step 48 and the second surface 84 of the thick portion 81. The second surface 84 opposes the step 48.

As shown in FIG. 3, the space 90 communicates with the introduction passage 95. To the space 90, high-pressure operating fluid is supplied from the main through hole 14 via the introduction passage 95. The introduction passage 95 is formed in the main flange 13 and the auxiliary flange 42. As described above, one end of the introduction passage 95, which is close to the main driven gear 21 as compared to the other end, communicates with the high-pressure space in the main through hole 14. The high-pressure space is filled with the high-pressure operating fluid. The other end of the introduction passage 95, which is close to the auxiliary driven gear 51 as compared to the one end, communicates with the space 90.

As shown in FIG. 5, when the high-pressure operating fluid is supplied to the space 90, the second surface 84 of the pressing member 80 is pressed by the operating fluid toward the main drive gear 20 along the axial direction. As a result, the first surface 83 of the pressing member 80 presses, through the intermediary of the receiving surface 74, the connecting member 70 toward the main drive gear 20 along the axial direction. As a result, the connecting member 70 presses the leading end face 27*a* of the main drive shaft 27 toward the main drive gear 20 along the axial direction.

<Characteristics of Gear Pump of Present Embodiment>

The gear pump 1 of the present embodiment has the following characteristics.

In the gear pump 1 of the present embodiment, when high-pressure operating fluid is supplied to the space 90, the connecting member 70 which is in contact with the outer edge portion of the leading end face 27*a* of the main drive shaft 27 presses the main drive shaft 27 toward the drive source. This makes it possible to cancel out the thrust force generated in the main drive gear 20, even when there is no space to provide a piston to be in contact with the central portion of the leading end face 27*a* of the main drive shaft 27.

The gear pump 1 of the present embodiment includes the pressing member 80 which is in contact with the receiving surface 74 and opposes the space 90. With the pressing member 80, the degree of freedom in position, inclination, etc. of the connecting member 70 is improved in the space in which the connecting member 70 is provided. This restrains the main connection part 30, the auxiliary connection part 60, and the connecting member 70 from being worn due to misalignment between the main drive shaft 27 and the auxiliary drive shaft 54, so as to restrain mechanical loss on account of the wear. When the pressing member 80 is not provided, because the connecting member 70 is tilted due to force generated by the misalignment between the main drive shaft 27 and the auxiliary drive shaft 54, the auxiliary flange 42 and the connecting member 70 make contact with each other and are worn, with the result that leakage of the operating fluid may increase. This problem is prevented by the pressing member 80 of the arrangement above.

In the gear pump 1 of the present embodiment, the pressing member 80 opposes the outer surface of the connecting member 70. The length in the axial direction of the element including the connecting member 70 and the pressing member 80 is shortened in this case as compared to a case where the pressing member 80 opposes an end face perpendicular to the axial direction of the connecting member 70, with the result that the gear pump 1 is downsized.

In the gear pump 1 of the present embodiment, the receiving surface 74 is a surface of the protrusion 72, which opposes the auxiliary pump 3. On this account, when the high-pressure operating fluid is supplied to the space 90, the pressing member 80 certainly presses the connecting member 70 toward the drive source through the intermediary of the receiving surface 74 of the protrusion 72.

In the gear pump 1 of the present embodiment, the pressing member 80 is provided in the auxiliary insertion hole 45 of the auxiliary flange 42 and the introduction passage 95 is formed in the main flange 13 and the auxiliary flange 42. With this arrangement, the contact area between the bearing 28 provided in the main through hole 14 and the main flange 13 is large. This restrains the operating fluid from leaking through a gap between the bearing 28 and the main flange 13, and hence the volume efficiency of the gear pump 1 is improved.

While the embodiment of the present invention has been described based on the figures, the scope of the invention is not limited to the above-described embodiment. The scope of the present invention is defined not only by the above embodiments but also by claims set forth below, and shall encompass the equivalents in the meaning of the claims and every modification within the scope of the claims.

The following will describe a modification of the gear pump 1 of the embodiment above. Structures identical with those of First Embodiment are denoted by the same reference symbols and are not explained again.

<Modification 1>

The pressing member 80 of the embodiment above is provided in the auxiliary flange 42. Meanwhile, the pressing member 80 of Modification 1 is provided in the main flange 13 as shown in FIG. 6.

The following will describe the structure of the connecting portion between the main drive gear 20 and the auxiliary drive gear 50 (i.e., the structure of the connecting portion between the main connection part 30 and the auxiliary connection part 60) according to Modification 1.

Figure 7:
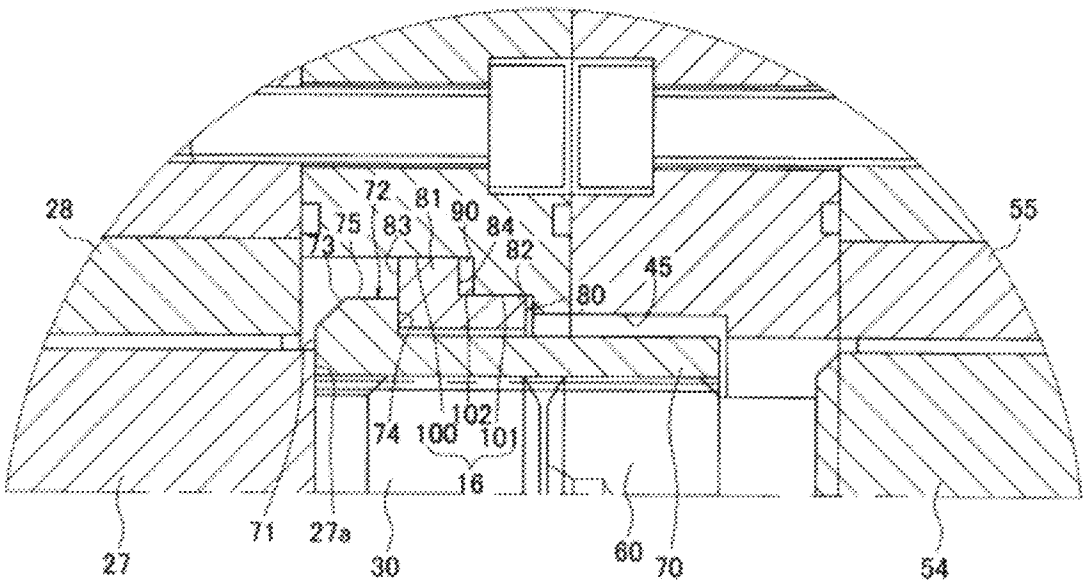
FIG. 7 is a partially enlarged cross sectional view showing a connecting portion where a main pump and an auxiliary pump included in the gear pump of FIG. 6 are connected to each other.

As shown in FIG. 7, the main connection part 30 and the auxiliary connection part 60 are connected to each other by the connecting member 70. The connecting member 70 is pressed toward the drive source (i.e., toward the main drive gear 20) along the axial direction, by a pressing member 80 which is pressed by high-pressure operating fluid supplied to a space 90.

Figure 6:
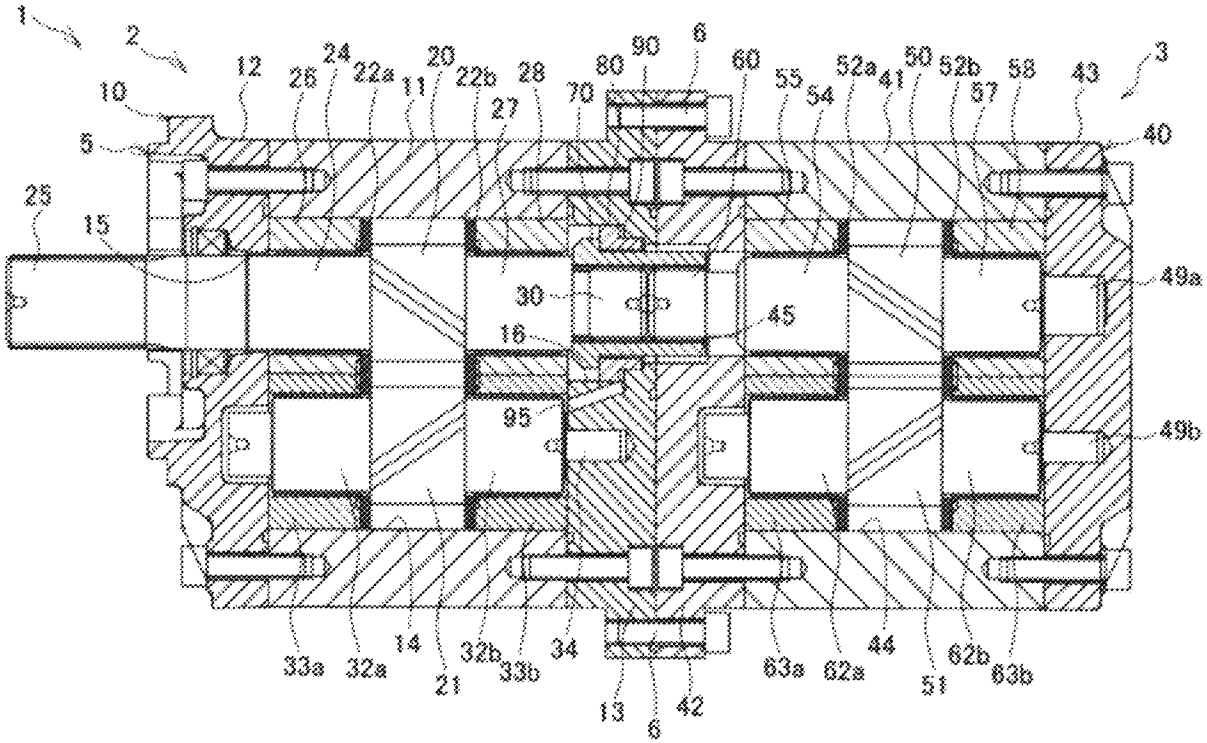
FIG. 6 is a cross section of a gear pump of Modification 1 of the present teaching.

As shown in FIG. 6, the connecting member 70 is a substantially cylindrical coupling having a through hole extending along the axial direction. The connecting member 70 is provided in the main insertion hole 16 and the auxiliary insertion hole 45. The connecting member 70 has an inner surface and an outside surface. The inner surface extends in the axial direction and opposes the main connection part 30 and the auxiliary connection part 60. The outer surface does not oppose the main connection part 30 and the auxiliary connection part 60. The connecting member 70 meshes with the outer circumferences of the main connection part 30 and the auxiliary connection part 60, and is able to rotate together with the main connection part 30 and the auxiliary connection part 60. As shown in FIG. 7, an end face 71 of the connecting member 70, which opposes the main pump 2 in the axial direction, is in contact with an outer edge portion of the leading end face 27*a* of the main drive shaft 27.

A protrusion 72 is formed at one end in the axial direction of the connecting member 70 (i.e., an end close to the main drive gear 20) to protrude outward in the radial direction from the outer surface of the connecting member 70. The protrusion 72 is trapezoidal in cross section taken along the axial direction. The protrusion 72 includes a slope surface 73, a receiving surface 74, and a circumferential surface 75. The protrusion 72 is close to the main drive gear 20 in the axial direction. The receiving surface 74 is far from the main drive gear 20 (i.e., close to the auxiliary drive gear 50) in the axial direction. The circumferential surface 75 connects the slope surface 73 with the receiving surface 74 and forms a leading end face of the protrusion 72.

The slope surface 73 extends in a direction intersecting with both the axial direction and the radial direction from the outer surface of the connecting member 70, and opposes the main drive gear 20. The slope surface 73 is connected to the end face 71. The receiving surface 74 extends outward in the radial direction from the outer surface of the connecting member 70, and opposes the auxiliary drive gear 50. The circumferential surface 75 extends along the axial direction.

As shown in FIG. 6, the pressing member 80 is ring-shaped and opposes the outer surface of the connecting member 70. As shown in FIG. 7, the pressing member 80 is close to the auxiliary drive gear 50 as compared to the protrusion 72 and is provided in the main insertion hole 16. The pressing member 80 is L-shaped in cross section taken along the axial direction. The pressing member 80 includes a thick portion 81 and a thin portion 82. The thick portion 81 is one of the portions close to the main drive gear 20 in the axial direction. The thin portion 82 is the other one of the portions far from the main drive gear 20 (i.e., close to the auxiliary drive gear 50) in the axial direction and is thinner than the thick portion 81 in the radial direction.

The thick portion 81 includes a first surface 83 in contact with the receiving surface 74 and a second surface 84 opposing the space 90. Each of the first surface 83 and the second surface 84 extends in the radial direction.

The main insertion hole 16 is defined by an inner circumferential surface 100 and an inner circumferential surface 101 which is shorter in diameter than the inner circumferential surface 100. The inner circumferential surfaces 100 and 101 are connected to each other by a step 102. The inner circumferential surface 100 is close to the main pump 2 as compared to the inner circumferential surface 101.

The space 90 is a sealed space which is formed in the main insertion hole 16 and is defined by the pressing member 80, the inner circumferential surface 100, and the step 102. To be more specific, the space 90 is sealed as the thick portion 81 is slidably in contact with the inner circumferential surface 100 and the thin portion 82 is slidably in contact with the inner circumferential surface 101. The space 90 is a gap between the step 102 and the second surface 84 of the thick portion 81. The second surface 84 opposes the step 102.

As shown in FIG. 6, the space 90 communicates with the introduction passage 95. To the space 90, high-pressure operating fluid is supplied from the main through hole 14 via the introduction passage 95. The introduction passage 95 is formed in the main flange 13. One end of the part of the introduction passage 95, which is close to the main driven gear 21 as compared to the other end, communicates with the high-pressure space in the main through hole 14. The high-pressure space is filled with the high-pressure operating fluid. The other end of the introduction passage 95, which is close to the auxiliary driven gear 51 as compared to the one end, communicates with the space 90.

As shown in FIG. 7, when the high-pressure operating fluid is supplied to the space 90, the second surface 84 of the pressing member 80 is pressed by the operating fluid toward the main drive gear 20 along the axial direction. As a result, the first surface 83 of the pressing member 80 presses, through the intermediary of the receiving surface 74, the connecting member 70 toward the main drive gear 20 along the axial direction. As a result, the connecting member 70 presses the leading end face 27*a* of the main drive shaft 27 toward the main drive gear 20 along the axial direction.

In Modification 1, the pressing member 80 is provided in the main insertion hole 16 of the main flange 13, and the introduction passage 95 is formed in the main flange 13. This facilitates the machining of the gear pump 1 because the introduction passage 95 is shortened.

<Modification 2>

In the embodiment above, the pressing member 80 is a member independent from the connecting member 70. (In other words, the pressing member 80 and the connecting member 70 are independent members detachable from each other.) Meanwhile, in Modification 2, a pressing member is integrated with a connecting member 110 as shown in FIG. 8.

The following will describe the structure of the connecting portion between the main drive gear 20 and the auxiliary drive gear 50 (i.e., the structure of the connecting portion between the main connection part 30 and the auxiliary connection part 60) according to Modification 2.

Figure 9:
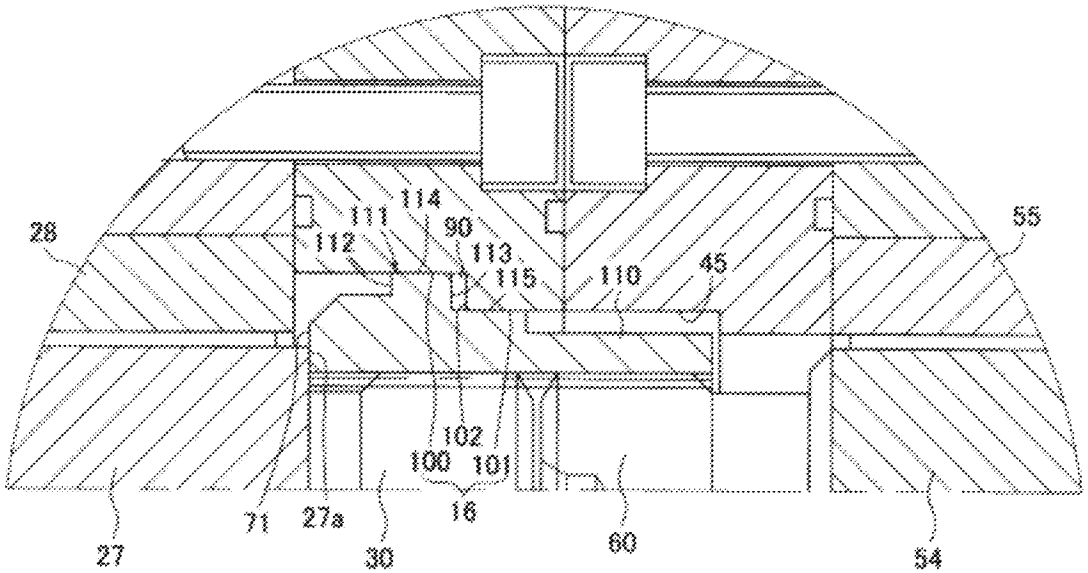
FIG. 9 is a partially enlarged cross sectional view showing a connecting portion where a main pump and an auxiliary pump included in the gear pump of FIG. 8 are connected to each other.

As shown in FIG. 9, the main connection part 30 and the auxiliary connection part 60 are connected to each other by the connecting member 70. The connecting member 110 is pressed toward the drive source (i.e., toward the main drive gear 20) along the axial direction, by high-pressure operating fluid supplied to a space 90.

Figure 8:
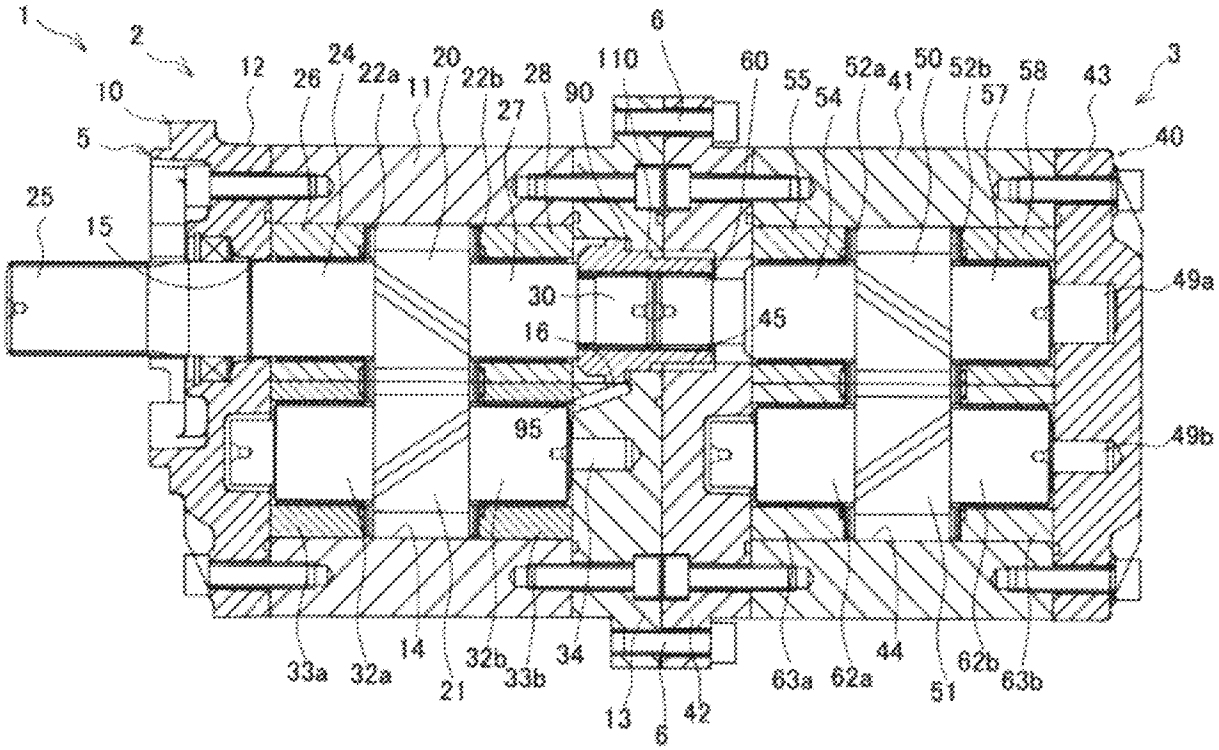
FIG. 8 is a cross section of a gear pump of Modification 2 of the present teaching.

As shown in FIG. 8, the connecting member 110 is a substantially cylindrical coupling having a through hole extending along the axial direction. The connecting member 110 is provided in the main insertion hole 16 and the auxiliary insertion hole 45. The connecting member 110 has an inner surface and an outside surface. The inner surface extends in the axial direction and opposes the main connection part 30 and the auxiliary connection part 60. The outer surface does not oppose the main connection part 30 and the auxiliary connection part 60. The connecting member 70 meshes with the outer circumferences of the main connection part 30 and the auxiliary connection part 60, and is able to rotate together with the main connection part 30 and the auxiliary connection part 60. As shown in FIG. 9, an end face 71 of the connecting member 110, which opposes the main pump 2, is in contact with an outer edge portion of the leading end face 27*a* of the main drive shaft 27.

A protrusion 111 is formed at one end in the axial direction of the connecting member 110 (i.e., an end close to the main drive gear 20) to protrude outward in the radial direction from the outer surface of the connecting member 110. The protrusion 111 is rectangular in cross section taken along the axial direction. The protrusion 111 includes a rising surface 112, a receiving surface 113, and a circumferential surface 114. The rising surface 112 is close to the main drive gear 20 in the axial direction. The receiving surface 113 is far from the main drive gear 20 (i.e., close to the auxiliary drive gear 50) in the axial direction. The circumferential surface 114 connects the rising surface 112 with the receiving surface 113 and forms a leading end face of the protrusion 111.

The rising surface 112 extends outward in the radial direction from the outer surface of the connecting member 110, and opposes the main drive gear 20. The receiving surface 113 extends outward in the radial direction from the outer surface of the connecting member 110, and opposes the auxiliary drive gear 50. The circumferential surface 114 extends along the axial direction.

Being similar to Modification 1, the main insertion hole 16 is defined by an inner circumferential surface 100 and an inner circumferential surface 101 which is shorter in diameter than the inner circumferential surface 100. The inner circumferential surfaces 100 and 101 are connected to each other by a step 102. The inner circumferential surface 100 is close to the main pump 2 as compared to the inner circumferential surface 101.

The space 90 is a sealed space which is formed in the main insertion hole 16 and is defined by the connecting member 110, the inner circumferential surface 100, and the step 102. To be more specific, the space 90 is sealed as the circumferential surface 114 is slidably in contact with the inner circumferential surface 100 and the outer surface 115 of the connecting member 110 is slidably in contact with the inner circumferential surface 101. The outside surface 115 is close to the auxiliary drive gear 50 in the axial direction as compared to the protrusion 111. The space 90 is a gap between the step 102 and the receiving surface 113.

As shown in FIG. 8, the space 90 communicates with the introduction passage 95. To the space 90, high-pressure operating fluid is supplied from the main through hole 14 via the introduction passage 95. The introduction passage 95 is formed in the main flange 13. One end of the part of the introduction passage 95, which is close to the main driven gear 21 as compared to the other end, communicates with the high-pressure space in the main through hole 14. The high-pressure space is filled with the high-pressure operating fluid. The other end of the introduction passage 95, which is close to the auxiliary driven gear 51 as compared to the one end, communicates with the space 90.

As shown in FIG. 9, when the high-pressure operating fluid is supplied to the space 90, the receiving surface 113 is pressed by the operating fluid toward the main drive gear 20 along the axial direction. As a result, the connecting member 110 presses the leading end face 27*a* of the main drive shaft 27 toward the main drive gear 20 along the axial direction.

According to Modification 2, manufacturing costs of the elements including the pressing member and the connecting member are reduced because the pressing member is formed to be integrated with the connecting member 110.

<Modification 3>

Figure 10:
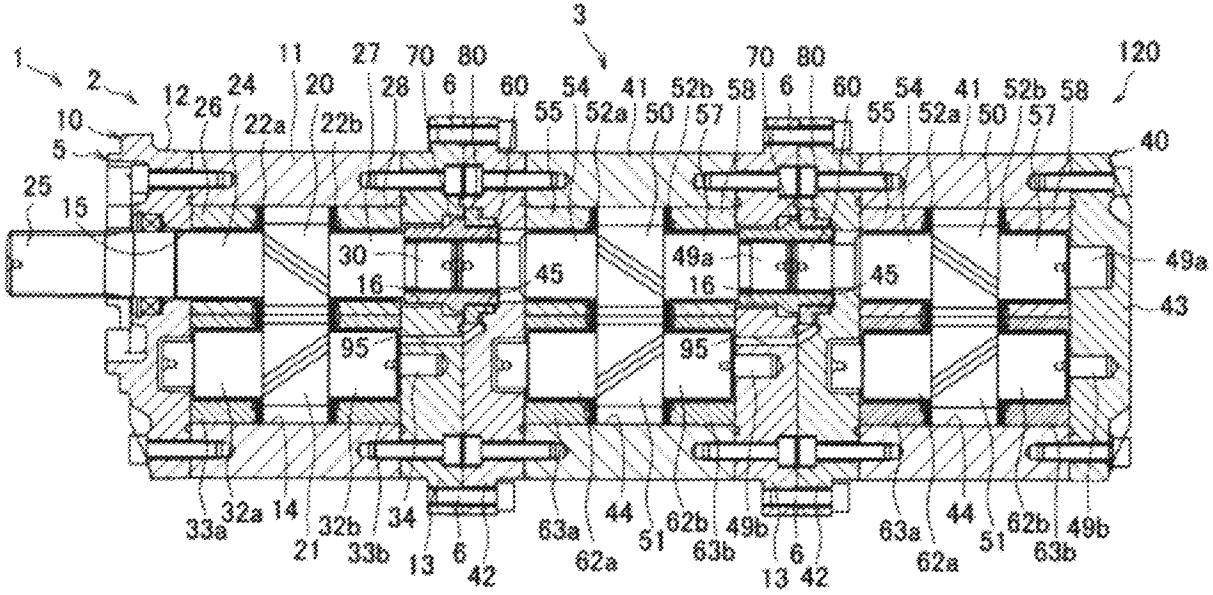
FIG. 10 is a cross section of a gear pump of Modification 3 of the present teaching.

As shown in FIG. 10, a gear pump 1 of Modification 3 includes a main pump 2 directly connected to a drive source (not illustrated), an auxiliary pump 3 connected in series to the main pump 2, and an additional pump 120 connected in series to the auxiliary pump 3. The additional pump 120 is provided on the side opposite to the main pump 2 over the auxiliary pump 3 (i.e., the main pump 2 and the auxiliary pump 3 are positioned between the drive source and the additional pump 120).

The gear pump 1 of Modification 3 is different from the gear pump 1 of the embodiment above in that the additional pump 120 is connected to the auxiliary pump 3. The additional pump 120 is structurally identical with the auxiliary pump 3.

According to Modification 3, the degree of freedom in design in consideration of the use is improved, because three pumps are serially connected to the drive source.

In Modification 3, the main pump 2 is connected to the drive source, the auxiliary pump 3 is connected to the main pump 2, and the additional pump 120 is connected to the auxiliary pump 3. Alternatively, the additional pump 120 is connected to the drive source, the main pump 2 is connected to the additional pump 120, and the auxiliary pump 3 is connected to the main pump 2. Advantageous effects similar to those of Modification 3 can be attained also in this case.

According to Modification 3, each of the main pump 2, the auxiliary pump 3, and the additional pump 120 includes a helical gear. Alternatively, for example, the first pump including a helical gear is connected to the drive source, the second pump including a helical gear is connected to the first pump, and the third pump not including a helical gear (e.g., including a spur gear) is connected to the second pump.

When three or more pumps are connected in series to the drive source, at least one of the two or more pumps excluding the pump farthest from the drive source is required to include a helical gear. The pump not including a helical gear may be a spur gear pump, a piston pump, or a bane pump.

The cases where the present teaching is applied to gear pumps have been described. In addition to this, the present teaching can be applied to a gear motor. Because a liquid pressure pump and a liquid pressure motor are substantially identical in terms of structure, the present teaching is applicable to a gear motor which includes a main motor including a helical gear and an auxiliary motor connected in series to the main motor.

The invention claimed is:

1. A gear pump system comprising:

a main pump connected to a drive source; and an auxiliary pump connected in series to the main pump, the main pump being positioned between the drive source and the auxiliary pump, the main pump including a main drive gear and a main driven gear, each of the main drive gear and the main driven gear being a helical gear, and a main drive shaft extending toward the auxiliary pump from an end face of the main drive gear, the end face opposing the auxiliary pump, and a main connection part being formed at a leading end surface of the main drive shaft, the main connection part being cylindrical in shape, the auxiliary pump including an auxiliary drive shaft extending toward the main drive shaft, an auxiliary connection part being formed at a leading end face of the auxiliary drive shaft, the auxiliary connection part being cylindrical in shape, the gear pump system further comprising:

a connecting member connecting the main connection part with the auxiliary connection part, the connecting member being in contact with an outer edge portion of the leading end face of the main drive shaft, and the connecting member being annular in shape;

a space opposing a receiving surface of the connecting member, the receiving surface opposing the auxiliary pump, and high-pressure operating fluid being supplied to the space and a pressing member in contact with the receiving surface, the pressing member opposing the space, and the pressing member being ring-shaped.

2. The gear pump system according to claim 1, wherein the connecting member has an inner surface extending in an axial direction of the main drive gear, the inner surface opposing the main connection part and the auxiliary connection part, and an outer surface extending in the axial direction, the outer surface not opposing the main connection part and the auxiliary connection part, and the pressing member opposes the outer surface.

3. The gear pump system according to claim 2, wherein the connecting member includes a protrusion protruding from the outer surface, and the receiving surface is a surface of the protrusion, the receiving surface opposing the auxiliary pump.

4. The gear pump system according to claim 3, further comprising:

a main casing housing the main drive gear and the main driven gear, the main casing including a main body having a main through hole in which the main drive gear and the main driven gear are provided, and the main body having openings formed in one end face close to the drive source and another end face far from the drive source so as to communicate with the main through hole, a mounting closing the opening formed in the one end face, and a main flange closing the opening formed in the another end face, and the main flange having a main insertion hole in which the main connection part and the connecting member are provided, the pressing member being provided in the main insertion hole, and an introduction passage being formed in the main flange to introduce the operating fluid from the main through hole to the space, one end of the introduction passage communicating with a high-pressure area of the main through hole with another end of the introduction passage communicating with the space.

5. The gear pump system according to claim 3, further comprising:

a main casing housing the main drive gear and the main driven gear, the main casing including a main body having a main through hole in which the main drive gear, the main driven gear and a bearing are provided, the bearing rotatably supporting the main drive shaft, and the main body having openings formed in one end face close to the drive source and another end face far from the drive source so as to communicate with the main through hole, a mounting closing the opening formed in the one end face, and a main flange closing the opening formed in the another end face, and the main flange having a main insertion hole in which the main connection part and the connecting member are provided; and an auxiliary casing housing an auxiliary drive gear and an auxiliary driven gear of the auxiliary pump, the auxiliary casing including an auxiliary body having an auxiliary through hole in which the auxiliary drive gear and the auxiliary driven gear are provided, and the auxiliary body having openings formed in one end face close to the drive source and another end face far from the drive force so as to communicate with the auxiliary through hole, an auxiliary flange closing the opening formed in the one end face, and the auxiliary flange having an auxiliary insertion hole in which the auxiliary connection part and the connecting member are provided, and a cover closing the opening formed in the another end face, the pressing member being provided in the auxiliary insertion hole, and an introduction passage being formed in the main flange and the auxiliary flange to introduce the operating fluid from the main through hole to the space, one end of the introduction passage communicating with a high-pressure area of the main through hole with another end of the introduction passage communicating with the space.

6. The gear pump system according to claim 3, comprising:

three or more pumps connected in series by the connecting member located between two adjacent pumps, the three or more pumps connected to the drive source including at least one of the main pump and at least one of the auxiliary pump.

7. The gear pump system according to claim 2, further comprising:

a main casing housing the main drive gear and the main driven gear, the main casing including a main body having a main through hole in which the main drive gear and the main driven gear are provided, and the main body having openings formed in one end face close to the drive source and another end face far from the drive source so as to communicate with the main through hole, a mounting closing the opening formed in the one end face, and a main flange closing the opening formed in the another end face, and the main flange having a main insertion hole in which the main connection part and the connecting member are provided, the pressing member being provided in the main insertion hole, and an introduction passage being formed in the main flange to introduce the operating fluid from the main through hole to the space, one end of the introduction passage communicating with a high-pressure area of the main through hole with another end of the introduction passage communicating with the space.

8. The gear pump system according to claim 2, further comprising:

a main casing housing the main drive gear and the main driven gear, the main casing including a main body having a main through hole in which the main drive gear, the main driven gear and a bearing are provided, the bearing rotatably supporting the main drive shaft, and the main body having openings formed in one end face close to the drive source and another end face far from the drive source so as to communicate with the main through hole, a mounting closing the opening formed in the one end face, and a main flange closing the opening formed in the another end face, and the main flange having a main insertion hole in which the main connection part and the connecting member are provided; and an auxiliary casing housing an auxiliary drive gear and an auxiliary driven gear of the auxiliary pump, the auxiliary casing including an auxiliary body having an auxiliary through hole in which the auxiliary drive gear and the auxiliary driven gear are provided, and the auxiliary body having openings formed in one end face close to the drive source and another end face far from the drive force so as to communicate with the auxiliary through hole, an auxiliary flange closing the opening formed in the one end face, and the auxiliary flange having an auxiliary insertion hole in which the auxiliary connection part and the connecting member are provided, and a cover closing the opening formed in the another end face, the pressing member being provided in the auxiliary insertion hole, and an introduction passage being formed in the main flange and the auxiliary flange to introduce the operating fluid from the main through hole to the space, one end of the introduction passage communicating with a high-pressure area of the main through hole with another end of the introduction passage communicating with the space.

9. The gear pump system according to claim 2, further comprising:

three or more pumps connected in series by the connecting member located between two adjacent pumps, the three or more pumps connected to the drive source including at least one of the main pump and at least one of the auxiliary pump.

10. The gear pump system according to claim 1, further comprising:

a main casing housing the main drive gear and the main driven gear, the main casing including a main body having a main through hole in which the main drive gear and the main driven gear are provided, and the main body having openings formed in one end face close to the drive source and another end face far from the drive source so as to communicate with the main through hole, a mounting closing the opening formed in the one end face, and a main flange closing the opening formed in the another end face, and the main flange having a main insertion hole in which the main connection part and the connecting member are provided, the pressing member being provided in the main insertion hole, and an introduction passage being formed in the main flange to introduce the operating fluid from the main through hole to the space, one end of the introduction passage communicating with a high-pressure area of the main through hole with another end of the introduction passage communicating with the space.

11. The gear pump system according to claim 10, further comprising:

three or more pumps connected in series by the connecting member located between two adjacent pumps, the three or more pumps connected to the drive source including at least one of the main pump and at least one of the auxiliary pump.

12. The gear pump system according to claim 1, further comprising:

a main casing housing the main drive gear and the main driven gear, the main casing including a main body having a main through hole in which the main drive gear, the main driven gear and a bearing are provided, the bearing rotatably supporting the main drive shaft, and the main body having openings formed in one end face close to the drive source and another end face far from the drive source so as to communicate with the main through hole, a mounting closing the opening formed in the one end face, and a main flange closing the opening formed in the another end face, and the main flange having a main insertion hole in which the main connection part and the connecting member are provided; and an auxiliary casing housing an auxiliary drive gear and an auxiliary driven gear of the auxiliary pump, the auxiliary casing including an auxiliary body having an auxiliary through hole in which the auxiliary drive gear and the auxiliary driven gear are provided, and the auxiliary body having openings formed in one end face close to the drive source and another end face far from the drive force so as to communicate with the auxiliary through hole, an auxiliary flange closing the opening formed in the one end face, and the auxiliary flange having an auxiliary insertion hole in which the auxiliary connection part and the connecting member are provided, and a cover closing the opening formed in the another end face, the pressing member being provided in the auxiliary insertion hole, and an introduction passage being formed in the main flange and the auxiliary flange to introduce the operating fluid from the main through hole to the space, one end of the introduction passage communicating with a high-pressure area of the main through hole with another end of the introduction passage communicating with the space.

13. The gear pump system according to claim 12, further comprising:

three or more pumps connected in series by the connecting member located between two adjacent pumps, the three or more pumps connected to the drive source including at least one of the main pump and at least one of the auxiliary pump.

14. The gear pump system according to claim 1, comprising:

three or more pumps connected in series by the connecting member located between two adjacent pumps, the three or more pumps connected to the drive source, including at least one of the main pump and at least one of the auxiliary pump.

15. A gear motor system comprising:

a main motor; and an auxiliary motor connected in series to the main motor, the main motor including a main drive gear and a main driven gear, each of the main drive gear and the main driven gear being a helical gear, and a main drive shaft extending toward the auxiliary motor from an end face of the main drive gear, the end face opposing the auxiliary motor, and a main connection part being formed at a leading end surface of the main drive shaft, the main connection part being cylindrical in shape, the auxiliary motor including an auxiliary drive shaft extending toward the main drive shaft, an auxiliary connection part being formed at a leading end face of the auxiliary drive shaft, the auxiliary connection part being cylindrical in shape, the gear motor system further comprising:

a connecting member connecting the main connection part with the auxiliary connection part, the connecting member being in contact with an outer edge portion of the leading end face of the main drive shaft, and the connecting member being annular in shape;

a space opposing a receiving surface of the connecting member, the receiving surface opposing the auxiliary motor, and high-pressure operating fluid being supplied to the space; and a pressing member in contact with the receiving surface, the pressing member opposing the space, and the pressing member being ring-shaped.

* * * * *